US009315974B2

(12) United States Patent
Brown et al.

(10) Patent No.: US 9,315,974 B2
(45) Date of Patent: Apr. 19, 2016

(54) NOZZLE POSITIONING ASSEMBLY FOR A FOUNTAIN SYSTEM

(75) Inventors: Kevin Thomas Brown, Mountain City, TX (US); Cesar Javier Trejo, New Braunfels, TX (US); Tim O'Brien, Canyon Lake, TX (US); David Olvera, Kyle, TX (US); Kenneth Lee Krauskopf, San Marcos, TX (US)

(73) Assignee: FOUNTAIN PEOPLE, INC., San Marcos, TX (US)

( * ) Notice: Subject to any disclaimer, the term of this patent is extended or adjusted under 35 U.S.C. 154(b) by 1163 days.

(21) Appl. No.: 13/297,021

(22) Filed: Nov. 15, 2011

(65) Prior Publication Data

US 2013/0119149 A1 May 16, 2013

(51) Int. Cl.

| | |
|---|---|
| ***B05B 15/08*** | (2006.01) |
| ***E03B 9/20*** | (2006.01) |
| ***B05B 15/10*** | (2006.01) |
| ***B05B 17/08*** | (2006.01) |

(52) U.S. Cl.
CPC . *E03B 9/20* (2013.01); *B05B 15/10* (2013.01); *B05B 17/08* (2013.01)

(58) Field of Classification Search
CPC ..... E03B 9/20; B05B 15/10; B05B 17/08
USPC ..... 239/589, 12, 16–20, 587.1–587.5
See application file for complete search history.

(56) References Cited

U.S. PATENT DOCUMENTS

| | | | | |
|---|---|---|---|---|
| 967,901 | A * | 8/1910 | Greenfield | F16L 35/00 138/120 |
| 5,934,558 | A * | 8/1999 | Samayoa | B05B 7/0416 137/512.1 |
| 6,053,423 | A * | 4/2000 | Jacobsen | B05B 17/08 239/17 |
| 6,250,570 | B1 * | 6/2001 | Starr | B05B 1/3426 239/17 |
| 2006/0175424 | A1 * | 8/2006 | Tatum | B05B 17/08 239/18 |
| 2009/0289126 | A1 * | 11/2009 | Claas | B05B 17/08 239/1 |

* cited by examiner

*Primary Examiner* — Len Tran
*Assistant Examiner* — Joel Zhou
(74) *Attorney, Agent, or Firm* — McAndrews, Held & Malloy, Ltd.

(57) ABSTRACT

A nozzle positioning assembly includes a first support shaft, a second support shaft, a first position adjustment assembly, a second position adjustment assembly, and a hub. The first and second support shafts have respective bodies with a center aperture, a spherical first end, and a second end opposite the spherical first end. The first and second position adjustment assembly include first and second link mounting ears positioned circumferentially from one another. The first position adjustment assembly is adapted to be affixed to the second end of the first support shaft and the second position adjustment assembly is adapted to be affixed to the second end of the second support shaft. The hub has a first end configured to receive and rotatably retain the spherical first end of the first support shaft, and a second end configured to receive and rotatably retain the spherical first end of the second support shaft.

16 Claims, 9 Drawing Sheets

NOZZLE POSITIONING ASSEMBLY FOR A FOUNTAIN SYSTEM

BACKGROUND

1. Field

This disclosure relates generally to a nozzle positioning assembly and, more particularly, to a nozzle positioning assembly for a fountain system 2. Related Art A variety of water fountain systems that are capable of varying a velocity and pattern of a water stream are known. Known water fountain systems may provide aesthetically entertaining water displays that are choreographed to music or associated light displays. For example, U.S. Pat. No. 6,053,423 (hereinafter "the '423 patent") discloses a fountain apparatus that includes a nozzle and lights which are selectable and moveable in at least two degrees of freedom about axes that are approximately perpendicular. According to the '423 patent, nozzle movement is preferably controlled by an automated control system that controls movement of the nozzle and selective activation of the lights. The automated control system may also be configured to control water streams to create a dynamic water display that can be synchronized to music or other light shows.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
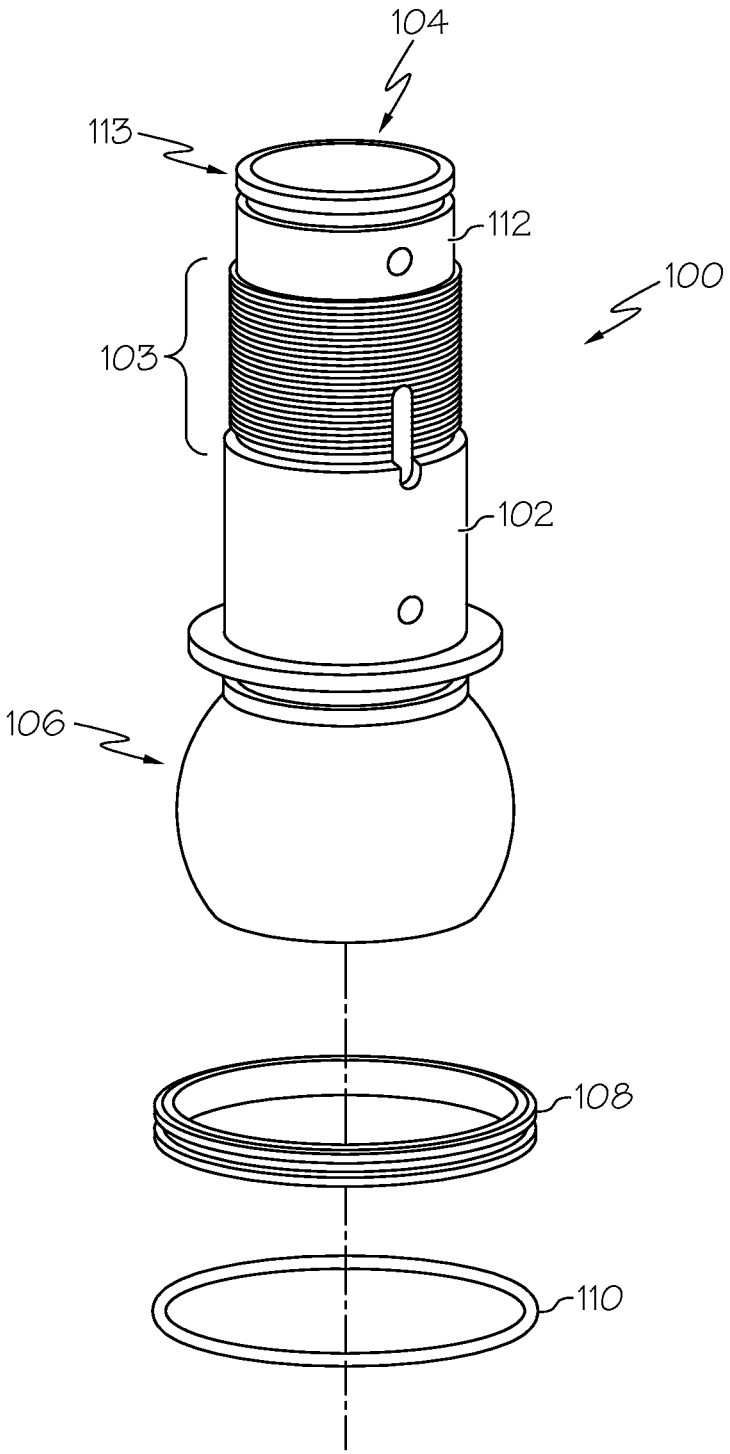
FIG. 1 is a diagram depicting a support shaft for a nozzle positioning system configured according to an embodiment of the present invention.

In the following detailed description of exemplary embodiments of the invention, specific exemplary embodiments in which the invention may be practiced are described in sufficient detail to enable those skilled in the art to practice the invention, and it is to be understood that other embodiments may be utilized and that logical, architectural, programmatic, mechanical, electrical, and other changes may be made without departing from the spirit or scope of the present invention. The following detailed description is, therefore, not to be taken in a limiting sense and the scope of the present invention is defined only by the appended claims and their equivalents. In particular, the embodiments described below may be embodied in various fountain systems.

According to one aspect of the present disclosure, a nozzle positioning assembly includes a first support shaft, a second support shaft, a first position adjustment assembly, a second position adjustment assembly, and a hub. The first support shaft has a body with a center aperture, a spherical first end, and a second end opposite the spherical first end. The first position adjustment assembly includes a first shaft collar having a first body with a center aperture and a first link mounting ear extending from the first body and a second shaft collar having a second body with a center aperture and a second link mounting ear extending from the second body. The first and second link mounting ears of the first position adjustment assembly are positioned circumferentially from one another. The center apertures of the first and second shaft collars are adapted to receive the second end of the first support shaft and at least one of the first and second shaft collars of the first position adjustment assembly is adapted to be affixed to the second end of the first support shaft.

The second support shaft has a body with a center aperture, a spherical first end, and a second end opposite the spherical first end. The second position adjustment assembly includes a third shaft collar having a first body with a center aperture and a first link mounting ear extending from the first body and a fourth shaft collar having a second body with a center aperture and a second link mounting ear extending from the second body. The first and second link mounting ears of the second position adjustment assembly are positioned circumferentially from one another. The center apertures of the third and fourth shaft collars are adapted to receive the second end of the second support shaft and at least one of the third and fourth shaft collars of the second position adjustment assembly is adapted to be affixed to the second end of the first support shaft.

The hub has a body with a center aperture, a first end configured to receive and rotatably retain the spherical first end of the first support shaft, and a second end configured to receive and rotatably retain the spherical first end of the second support shaft. The first link mounting ears of the first and second position adjustment assemblies are substantially aligned along a first line parallel to a first axis of the hub and the second link mounting ears of the of the first and second position adjustment assemblies are substantially aligned along a second line parallel to the first axis of the hub.

According to various aspects of the present disclosure, a fountain system is disclosed herein that may include one or more nozzle positioning assemblies configured according to the present disclosure. In general, the disclosed nozzle positioning assemblies have a wider range of motion than known nozzle positioning assemblies and may also be readily synchronized with music or lights. A nozzle positioning assembly configured according to the present disclosure may advantageously provide for reduced maintenance and, in turn, lower operating costs. The disclosed nozzle positioning assembly is readily scalable and may be constructed to have a relatively low moving part mass and a relatively compact working footprint (e.g., a twenty-four inch diameter or less).

A nozzle positioning assembly configured according to the present disclosure may be implemented, if desired, without external delivery hoses and may be designed for relatively low energy consumption (depending on employed motors). The disclosed nozzle positioning assembly has a relatively wide range of motion and may employ low friction coatings and/or low friction materials to aid in reducing maintenance costs. A nozzle positioning assembly configured according to the present disclosure may be programmed for linear or non-linear movement and may employ one of a variety of control protocols. The disclosed nozzle positioning assembly may be submerged in a fluid (e.g., water) and is generally designed to be easily serviced.

A nozzle positioning assembly configured according to the present disclosure allows fluid flow through a central axis of the assembly and employs dual ball joint articulation to facilitate pan, tilt, and rotation of an associated nozzle. In one or more embodiments, the disclosed nozzle positioning assembly employs integrated linear guides and a mounting flange that may be readily coupled to a pump or other structure. A nozzle positioning assembly configured according to the present disclosure may include multiple nozzles or other head attachments and may also include lights positioned around a nozzle of the assembly.

Figure 2:
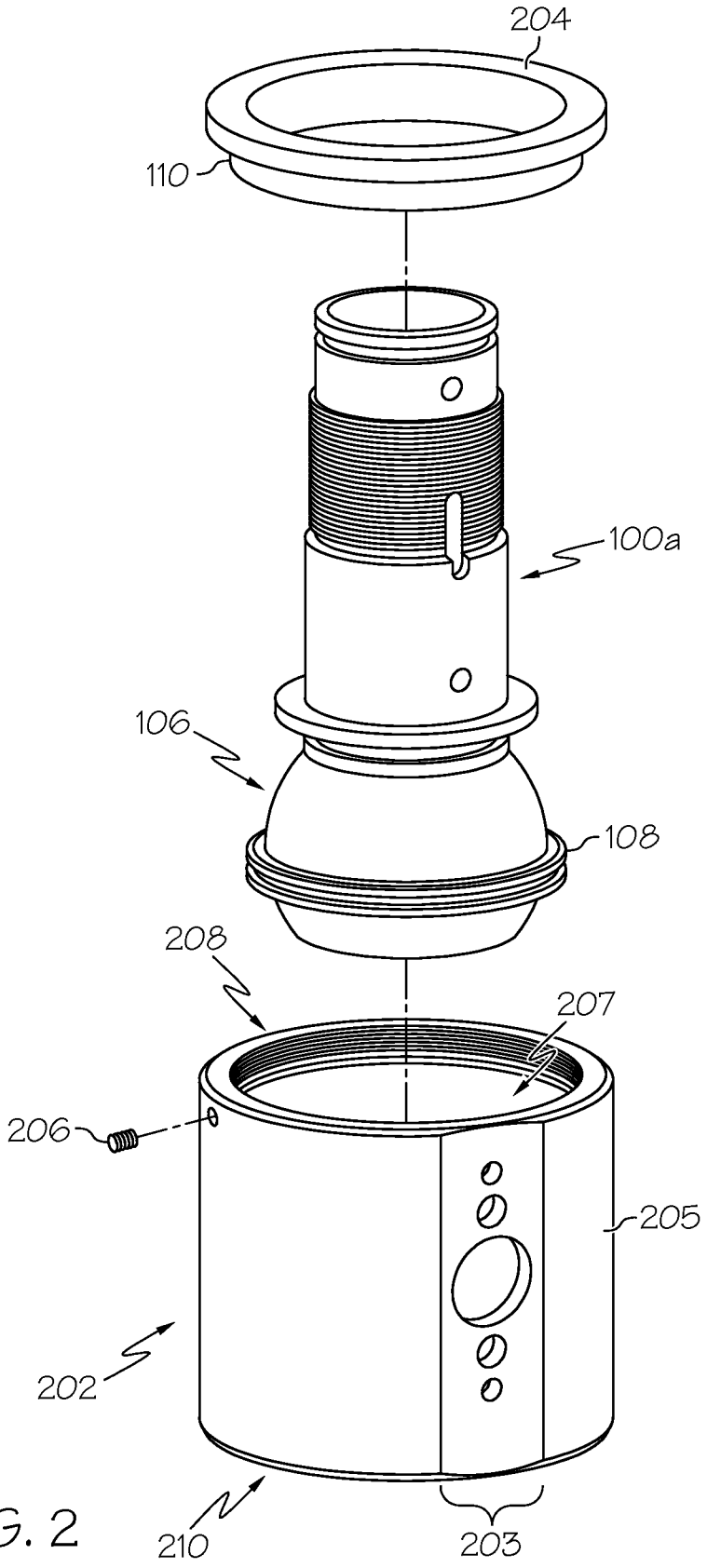
FIG. 2 is a diagram depicting a support shaft and hub for a nozzle positioning system configured according to an embodiment of the present invention.

With reference to FIG. 1, a support shaft 100 for a nozzle positioning assembly includes a body 102 with a center aperture 104, a spherical first end 106, and a second end 112 opposite spherical first end 106. As is discussed in further detail below in conjunction with FIG. 2, an o-ring 110 and bushing 108 are used to provide a fluid-tight seal for spherical end 106 of support shaft 100. With reference to FIG. 2, hub 202 has a body 205 with a center aperture 207, a first end 208 configured to receive and rotatably retain spherical first end 106 of a first support shaft 100*a*, and a second end 210 (opposite first end 208) configured to receive and rotatably retain a spherical first end 106 of a second support shaft 100*b*. First and second ends 208 and 210 include threads for engaging threads of compression ring socket 204, which may be made of a wide variety of materials, e.g., Delrin or other composite material. Set screw 206 may be threadingly engaged in an aperture formed in body 202 to prevent compression ring socket 204 from rotating during operation.

Figure 3:
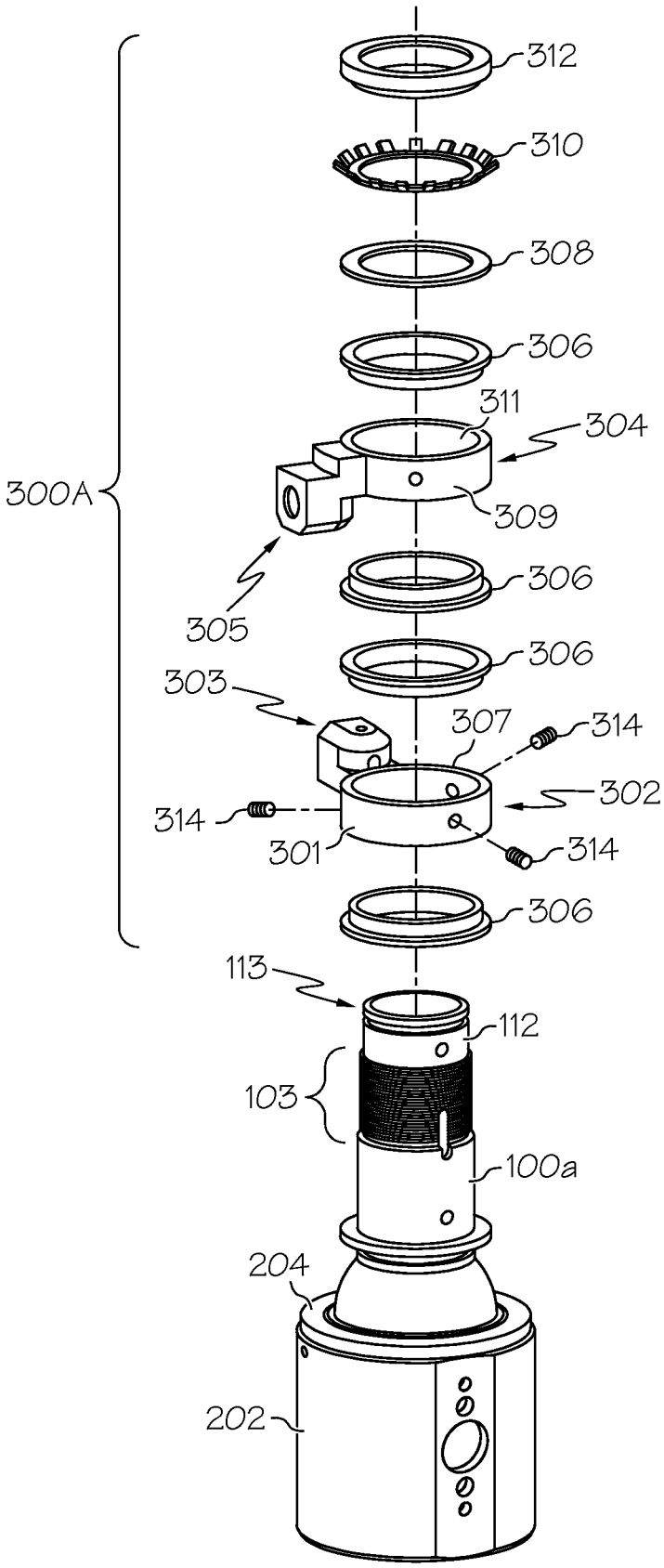
FIG. 3 is a diagram depicting a support shaft, a hub, and position adjustment assembly for a nozzle positioning system configured according to an embodiment of the present invention.

With reference to FIG. 3, a position adjustment assembly 300*a* includes a first shaft collar 302 having a first body 301 with a center aperture 307 and a first link mounting ear 303 (extending from body 301) and a second shaft collar 304 having a second body 309 with a center aperture 311 and a second link mounting ear 305 (extending from body 309). First and second link mounting ears 303, 305 of position adjustment assembly 300*a* are positioned circumferentially from one another. For example, a degree of rotation between first and second link mounting ears 303, 305 may range between fifteen and one-hundred sixty-five degrees. Center apertures 307, 311 of respective first and second shaft collars 302, 304 are adapted to receive second end 112 of support shaft 102.

At least one of shaft collars 302, 304 of position adjustment assembly 300*a* is adapted to be affixed to second end 112 of support shaft 100. For example, set screws 314 may be threadingly received by apertures in collar 302 to lock collar 302 to body 102 of support shaft 100*a*. As is also illustrated, position adjustment assembly 300*a* in one or more embodiments includes four bushings 306. Aperture 307 in collar 302 receives two of bushings 306 and aperture 311 in collar 304 receives two of bushings 306. A thrust bushing 308 is designed to contact lock washer 310, which is configured to engage lock nut 312 to retain assembly 300*a* on body 102 of support shaft 100*a*.

Figure 4:
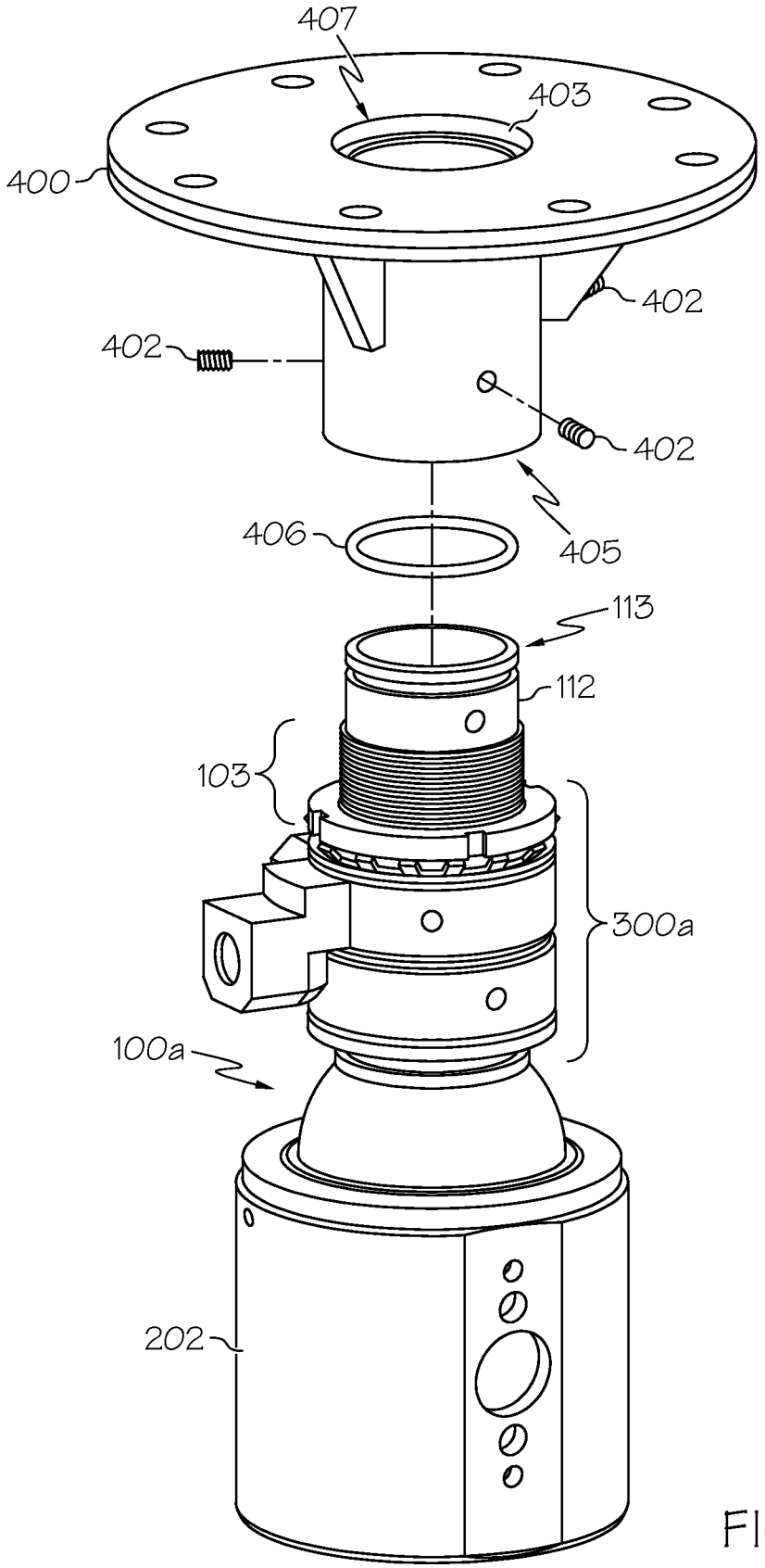
FIG. 4 is a diagram depicting a support shaft, a hub, a position adjustment assembly (mounted on the support shaft), and a mounting flange for a nozzle positioning system configured according to an embodiment of the present invention.

With reference to FIG. 4, second end 112 of shaft 100*a* is shown with position adjustment assembly 300*a* affixed to body 102 and a spherical end 106 of shaft 100*a* rotatably coupled to hub 202. FIG. 4 also illustrates mounting flange 400, which includes a center aperture 403, a first end 405, and a flanged second end 407 (opposite first end 405). First end 405 of mounting flange 400 is adapted to receive second end 112 of shaft 100*a*. An o-ring 406 (retained in groove 113) is employed to fluidly seal second end 112 of shaft 100*a* and flange 400. Set screws 402 are employed to mechanically affix first end 405 of flange 400 to second end 112 of shaft 100*a*. A second end of flange 400 may be, for example, mechanically coupled to a fluid pump (not shown in FIG. 4), which is configured to pump fluid through center aperture 403.

Figure 5:
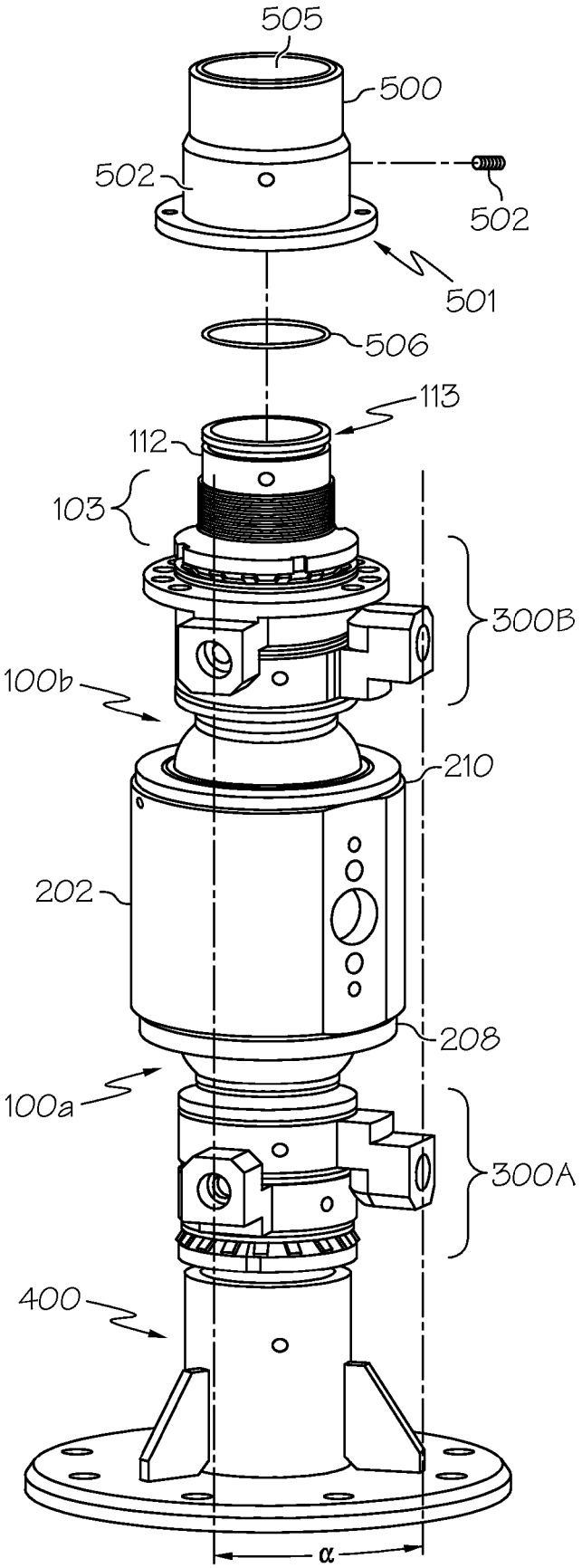
FIG. 5 is a diagram depicting first and second support shafts, a hub, first and second position adjustment assemblies (mounted on the respective first and second support shafts), a mounting flange, and a nozzle for a nozzle positioning system configured according to an embodiment of the present invention.

With reference to FIG. 5, shaft 100*a* is shown with position adjustment assembly 300*a* affixed to body 102, a spherical end 106 of shaft 100*a* rotatably coupled to a first end 208 of hub 202 and second end 112 of shaft 100*a* mechanically coupled to first end 405 of mounting flange 400. As is also illustrated in FIG. 5, shaft 100*b* is shown with position adjustment assembly 300*b* affixed to body 102 of shaft 100*b* and a spherical end 106 of shaft 100*b* rotatably coupled to a second end 210 of hub 202. An o-ring 506 (retained in groove 113 of shaft 100*b*) is employed to fluidly seal second end 112 of shaft 100*b* and fluid nozzle 500. Second end 112 of shaft 100*b* is configured to be mechanically coupled to a first end 501 of nozzle 500 using set screws 502 threadingly received in a body of nozzle 500. Nozzle 500 also includes a center aperture 505 that is aligned with center apertures 104 (of shafts 100*a* and 100*b*), 207 (of hub 202), and 403 (of mounting flange 400).

Figure 6:
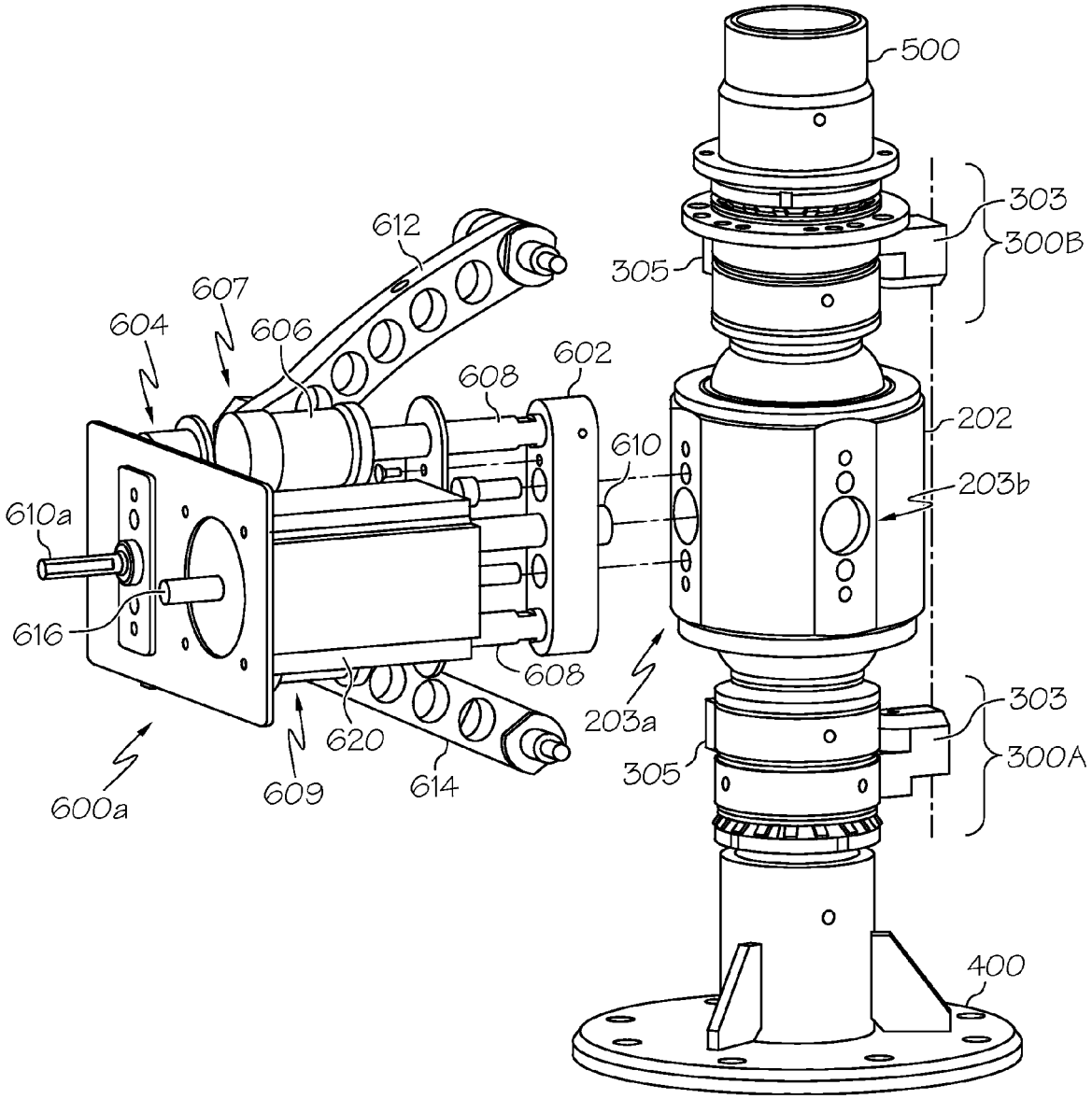
FIG. 6 is a diagram depicting first and second support shafts, a hub, first and second position adjustment assemblies (mounted on the respective first and second support shafts), a mounting flange, a nozzle, and a linear guide for a nozzle positioning system configured according to an embodiment of the present invention.

With reference to FIG. 6, a first linear guide 600*a* (that is adapted to be affixed to an exterior of hub 202 at a first location 203*a*) is illustrated. Linear guide 600 includes a first hub mounting plate 602 (adapted to be coupled to hub 202 at first location 203*a* with screws), a motor mounting plate 604, an adjustment screw 610, a pair of first guide rods 608 (adapted to mechanically couple motor mounting plate 604 to hub mounting plate 602), and a carriage 606 (positioned between hub mounting plate 602 and motor mounting plate 604). Carriage 606 includes apertures to receive guide rods 608 and adjustment screw 610, a first attachment point 607, and a second attachment point 609 (spaced from first attachment point 607). Attachment point 607 is configured to pivotally retain a first end of linkage 612 and attachment point 609 is configured to pivotally retain a first end of linkage 614.

A second end of linkage 612 is pivotally retained at a first link mounting ear 303 of assembly 300*b* and a second end of linkage 614 is pivotally retained at a first link mounting ear 303 of assembly 300*a*. Adjustment screw 610, when actuated, is adapted to move carriage 606 between hub mounting plate 602 and motor mounting plate 604 along guide rods 608. For example, a shaft 616 of motor 620 may include a pulley (not shown) that is coupled (by a belt, not shown) to a pulley that is attached to end 610*a* of screw 610. Motor 620 may, for example, be a stepper motor or a servo motor. In an alternate embodiment, a shaft of motor 620 is directly coupled (using a shaft coupler, not shown) to shaft 610. In one or more embodiments, a second linear guide 600*b* (which is substantially identical to linear guide 600*a*) is affixed to hub 202 at a second location 203*b*. Similar to first linear guide 600*a*, attachment points of a carriage 606 of second linear guide 600*b* are pivotally coupled to respective second link mounting ears 305 of assemblies 300*a* and 300*b*.

Figure 7:
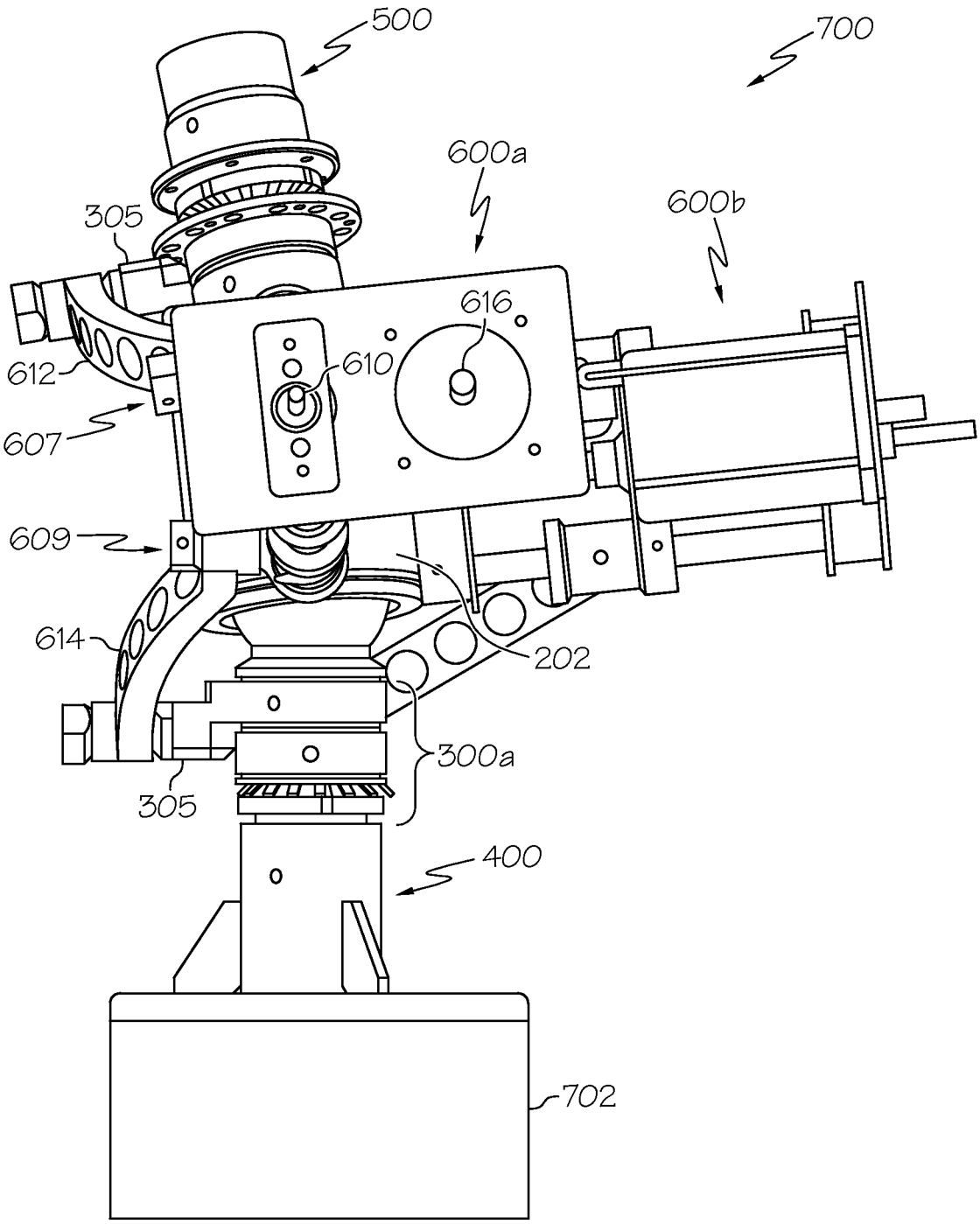
FIG. 7 is a diagram of a nozzle positioning system configured according to an embodiment of the present invention.

With reference to FIG. 7, a complete nozzle positioning assembly 700, configured according to an embodiment of the present disclosure, is shown attached to a fluid pump 702. Assembly 700 includes linear guides 600*a* and 600*b*, which are mounted to hub 202 at locations 203*a* and 203*b*, respectively. Assembly 700 also includes support shafts 100*a*, 100*b* rotatably retained by hub 202. As discussed above, support shafts 100*a*, 100*b* have assemblies 300*a*, 300*b* mounted on respective bodies 102 of shafts 100*a*, 100*b*. As is shown in FIG. 7, mounting flange 400 is coupled to pump 702 which, when operational, pumps fluid through center aperture 505 of nozzle 500 in a pattern that is dictated through control of linear guides 600*a* and 600*b*. The components of assembly 700 may be made from a wide variety of materials. For example, support shafts 100*a*, 100*b* and hub 202 may be made from stainless steel, a plated steel, or a composite plastic.

Figure 8:
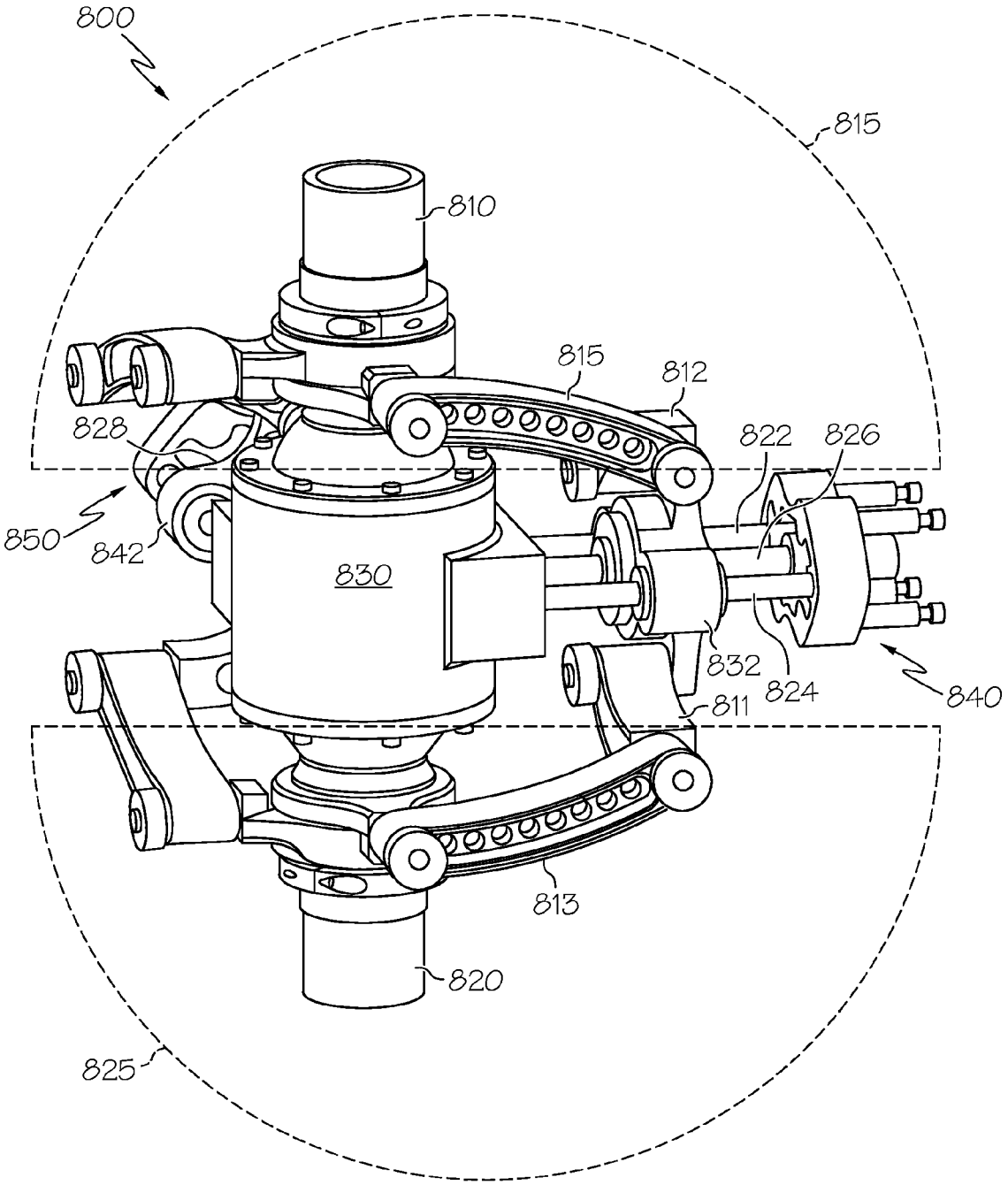
FIG. 8 is a diagram of a nozzle positioning system configured according to another embodiment of the present invention.

With reference to FIG. 8 a nozzle positioning assembly 800, configured according to another embodiment of the present disclosure, is illustrated. Nozzle positioning assembly 800, while similar to nozzle positioning assembly 700, has some minor modifications. As shown in FIG. 8, nozzle positioning assembly 800 includes a nozzle-end ball joint (including a position adjustment assembly 300 mounted on a support shaft 100) 810 and a base-end ball joint (including a position adjustment assembly 300 mounted on a support shaft 100) 820, which are rotatably coupled to hub 830 (constructed substantially in accordance with hub 202). Ball joints 810, 820 may be selectively moved in hemispheres 815, 825, respectively, through manipulation of linkages coupled between ball joints 810, 820 and linear guides 840, 850. Fluid delivered by assembly 800 passes from base-end ball joint 820 through a center of hub 830 and exits through an aperture of nozzle-end ball joint 810.

Linear guides 840, 850 are attached to hub 830 at positions separated by about ninety degrees to about one-hundred twenty degrees, about axes running through ball joints 810, 820 and the center of hub 830. Guide rods 822, 824 are fixedly mounted to hub 830 parallel to lead screw 826 (two guide rods are also fixedly mounted to hub 830 in parallel with lead screw 828). Carriage 832 is slidably-mounted on guide rods 822, 824 through two apertures and is threadingly engaged with lead screw 826. Carriage 842 is similarly mounted on lead screw 828 and corresponding guide rods are attached to hub 830. As will be appreciated, rotation of lead screw 826 via an attached motor moves carriage 832 along guide rods 822, 824 through clockwise and counterclockwise manipulation of lead screw 826.

Carriage 832 is pivotally coupled (at respective attachment points) to two short linkages 811, 812. Linkage 811 is moved by carriage 832 to actuate a rotation of ball joint 820, and short linkage 812 is moved by carriage 832 to manipulate rotation of ball joint 810. Short linkage 811 is rotatably coupled to the end of long linkage 813 and short linkage 812 is rotatably coupled to the end of long linkage 815. As carriage 832 is moved towards and away from hub 830 through actuation of lead screw 836, short and long linkages 811, 812, 803, 813 move together to cause rotation of ball joints 810, 820 along the same plane. Similarly, the linear guide associated with lead screw 828 provides rotation of each of the ball joints 810, 820 in planes along lead screw 828 from the motion generated from carriage 842. A controller (not shown in FIG. 8) is configured to synchronously control the rotation of lead screws 826, 828 to precisely move carriages 832, 842 along guide rods to effect movement of ball joints 810, 820 in planes parallel with lead screws 826, 828, respectively. When a nozzle is attached to ball joint 810, the controller is able to selectively position the nozzle in any static or dynamic position within the hemispheres 815, 825 and thereby provide multiple patterns and configurations of a spraying fluid, such as water, that emanates from the nozzle.

Figure 9:
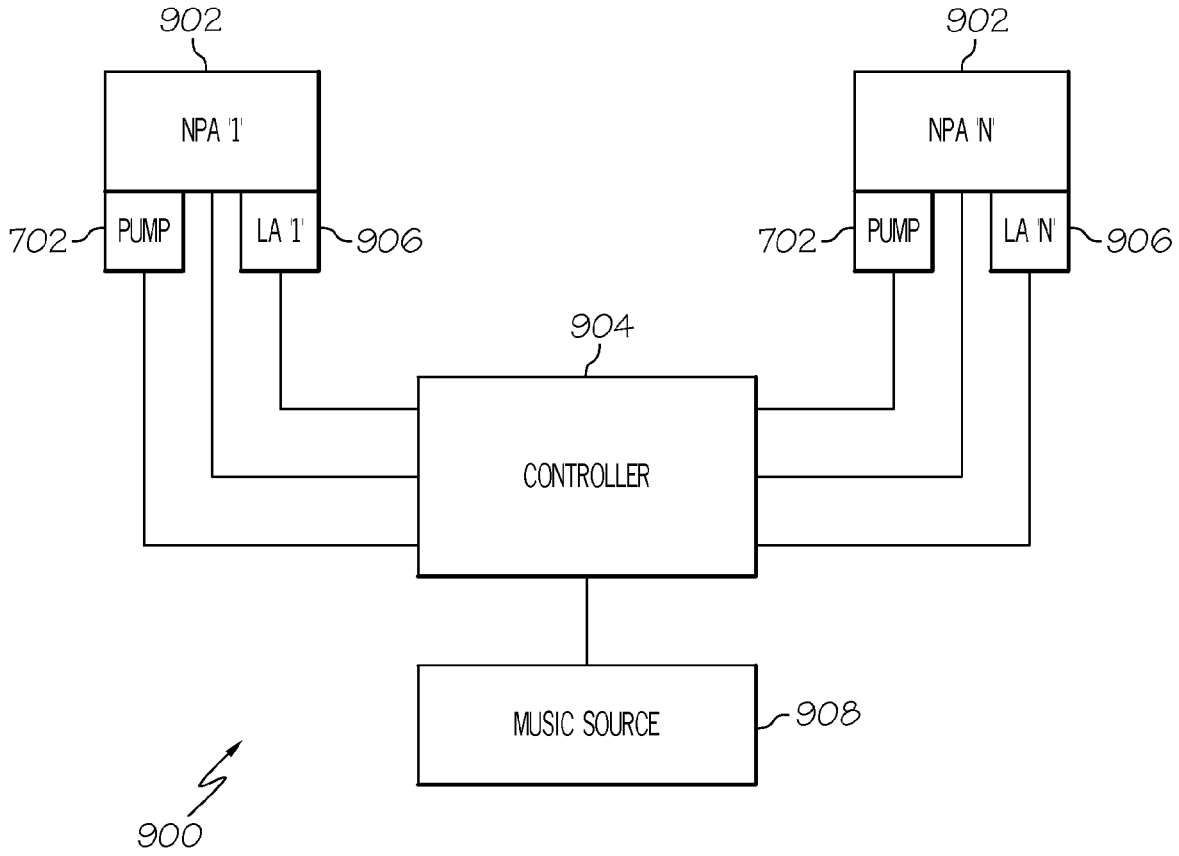
FIG. 9 is a diagram of a fountain system that includes a nozzle positioning system configured according to an embodiment of the present invention.

With reference to FIG. 9, a fountain system 900 is illustrated that includes multiple nozzle position assemblies 902 configured according to the present disclosure. For example, nozzle position assemblies (NPAs) 902 may take the form of assemblies 700 and/or 800. As is shown in FIG. 9, fountain system 900 includes a controller (or computer system) 904 that is electrically coupled to pumps 702 (to control fluid flow through NPAs 902), NPAs 902 (to control a direction or pattern of the nozzles of NPAs 902), light assemblies (LAs) 906, and music source (e.g., a compact disk (CD) player) 908. In one or more embodiments, each NPA 902 includes an LA 906, which provides light that may be, for example, synchronized with music source 908. Alternatively, LAs 906 may be omitted or limited to less than one LA 906 for each NPA 902. Controller 904 may include, for example, one or more programmed processors, programmed microcontrollers, programmable logic devices (PLDs), and/or application specific integrated circuits (ASICs).

Accordingly, a nozzle positioning assembly has been described herein that, when incorporated into a fountain system, provides the capability of articulating a nozzle in multiple degrees of freedom to provide a fountain with various features and movement, which may be controlled to modify trajectory, direction, and spray patterns and provide an entertaining water fountain with a multitude of computer-controlled effects.

As may be used herein, a software system can include one or more objects, agents, threads, subroutines, separate software applications, two or more lines of code or other suitable software structures operating in one or more separate software applications, on one or more different processors, or other suitable software architectures.

As will be appreciated, the processes in preferred embodiments of the present invention may be implemented using any combination of software, firmware, or hardware. As a preparatory step to practicing the invention in software, code (whether software or firmware) according to a preferred embodiment will typically be stored in one or more machine readable storage mediums such as fixed (hard) drives, diskettes, optical disks, magnetic tape, semiconductor memories such as read-only memories (ROMs), programmable ROMs (PROMs), etc., thereby making an article of manufacture in accordance with the invention. The article of manufacture containing the code is used by either executing the code directly from the storage device, or by copying the code from the storage device into another storage device such as a hard disk, random access memory (RAM), etc. The method form of the invention may be practiced by combining one or more machine-readable storage devices containing the code according to the present invention with appropriate standard processor hardware to execute the code contained therein. An apparatus for practicing the invention could be one or more processors and storage systems containing or having network access to one or more programs coded in accordance with the invention.

Although the invention is described herein with reference to specific embodiments, various modifications and changes can be made without departing from the scope of the present invention as set forth in the claims below. For example, many of the techniques disclosed herein are broadly applicable to a variety of transmitters (or transmitters of transceivers) employed in wired or wireless communication systems. Accordingly, the specification and figures are to be regarded in an illustrative rather than a restrictive sense, and all such modifications are intended to be included with the scope of the present invention. Any benefits, advantages, or solution to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A nozzle positioning assembly, comprising: a first support shaft having a body with a center aperture, a spherical first end, and a second end opposite the spherical first end; a first position adjustment assembly including a first shaft collar having a first body with a center aperture and a first link mounting ear extending from the first body and a second shaft collar having a second body with a center aperture and a second link mounting ear extending from the second body, wherein the first and second link mounting ears of the first position adjustment assembly are positioned circumferentially from one another, and wherein the center apertures of the first and second shaft collars are adapted to receive the second end of the first support shaft and at least one of the first and second shaft collars of the first position adjustment assembly is adapted to be affixed to the second end of the first support shaft; a second support shaft having a body with a center aperture, a spherical first end, and a second end opposite the spherical first end; a second position adjustment assembly including a third shaft collar having a first body with a center aperture and a first link mounting ear extending from the first body and a fourth shaft collar having a second body with a center aperture and a second link mounting ear extending from the second body, wherein the first and second link mounting ears of the second position adjustment assembly are positioned circumferentially from one another, and wherein the center apertures of the third and fourth shaft collars are adapted to receive the second end of the second support shaft and at least one of the third and fourth shaft collars of the second position adjustment assembly is adapted to be affixed to the second end of the second support shaft; and a hub having a body with a center aperture, a first end configured to receive and rotatably retain the spherical first end of the first support shaft, and a second end configured to receive and rotatably retain the spherical first end of the second support shaft, wherein the first link mounting ears of the first and second position adjustment assemblies are substantially aligned along a first line parallel to a first axis of the hub and the second link mounting ears of the first and second position adjustment assemblies are substantially aligned along a second line parallel to the first axis of the hub; and a fluid nozzle coupled to the second end of the second support shaft.

2. The nozzle positioning assembly of claim 1, further comprising: a mounting flange coupled to the second end of the first support shaft.

3. The nozzle positioning assembly of claim 1, further comprising: a first linear guide adapted to be affixed to an exterior of the hub at a first location, the first linear guide including: a first hub mounting plate adapted to contact the exterior of the hub at the first location; a first motor mounting plate; a first adjustment screw; a pair of first guide rods adapted to couple the first motor mounting plate to the first hub mounting plate; and a first carriage positioned between the first hub mounting plate and the first motor mounting plate, wherein the first carriage includes apertures to receive the pair of first guide rods and the adjustment screw, a first attachment point, and a second attachment point spaced from the first attachment point, and wherein the adjustment screw, when actuated, is adapted to move the first carriage between the first hub mounting plate and the first motor mounting plate along the pair of first guide rods.

4. The nozzle positioning assembly of claim 3, further comprising: a second linear guide adapted to be affixed to the exterior of the hub at a second location positioned circumferentially from the first location, the second linear guide including: a second hub mounting plate adapted to contact the exterior of the hub at the second location; a second motor mounting plate; a second adjustment screw; a pair of second guide rods adapted to couple the second motor mounting plate to the second hub mounting plate; and a second carriage positioned between the second hub mounting plate and the second motor mounting plate, wherein the second carriage includes apertures to receive the pair of second guide rods and the adjustment screw, a first attachment point, and a second attachment point spaced from the first attachment point, and wherein the adjustment screw, when actuated, is adapted to move the second carriage between the second hub mounting plate and the second motor mounting plate along the pair of second guide rods.

5. The nozzle positioning assembly of claim 4, further comprising: a first linkage pivotally coupled between the first attachment point of the first carriage and the first link mounting ear of the first position adjustment assembly; a second linkage pivotally coupled between the second attachment point of the first carriage and the first link mounting ear of the second position adjustment assembly; a third linkage pivotally coupled between the first attachment point of the second carriage and the second link mounting ear of the first position adjustment assembly; and a fourth linkage pivotally coupled between the second attachment point of the second carriage and the second link mounting ear of the second position adjustment assembly.

6. The nozzle positioning assembly of claim 1, wherein the first and second support shafts and the hub are made from stainless steel, a plated steel, or a composite plastic.

7. A fountain system, comprising: a nozzle positioning assembly including:

a first support shaft having a body with a center aperture, a spherical first end, and a second end opposite the spherical first end; a first position adjustment assembly including a first shaft collar having a first link mounting ear and a second shaft collar having a second link mounting ear, wherein the first and second link mounting ears of the first position adjustment assembly are positioned circumferentially from one another, and wherein center apertures of the first and second shaft collars are adapted to receive the second end of the first support shaft and at least one of the first and second shaft collars of the first position adjustment assembly is adapted to be affixed to the second end of the first support shaft; a second support shaft having a body with a center aperture, a spherical first end, and a second end opposite the spherical first end; a second position adjustment assembly including a third shaft collar having a first link mounting ear and a fourth shaft collar having a second link mounting ear, wherein the first and second link mounting ears of the second position adjustment assembly are positioned circumferentially from one another, and wherein center apertures of the third and fourth shaft collars are adapted to receive the second end of the second support shaft and at least one of the third and fourth shaft collars of the second position adjustment assembly is adapted to be affixed to the second end of the second support shaft; and a hub having a body with a center aperture, a first end configured to receive and rotatably retain the spherical first end of the first support shaft, and a second end configured to receive and rotatably retain the spherical first end of the second support shaft, wherein the first link mounting ears of the first and second position adjustment assemblies are substantially aligned along a first line parallel to a first axis of the hub and the second link mounting ears of the of the first and second position adjustment assemblies are substantially aligned along a second line parallel to the first axis of the hub; and a fluid pump coupled to the second end of the first support shaft; and a fluid nozzle coupled to the second end of the second support shaft.

8. The fountain system of claim 7, further comprising: a mounting flange coupled between the second end of the first support shaft and the fluid pump.

9. The fountain system of claim 7, further comprising: a first linear guide adapted to be affixed to an exterior of the hub at a first location, the first linear guide including: a first hub mounting plate adapted to contact the exterior of the hub at the first location; a first motor mounting plate; a first adjustment screw; a pair of first guide rods adapted to couple the first motor mounting plate to the first hub mounting plate; and a first carriage positioned between the first hub mounting plate and the first motor mounting plate, wherein the first carriage includes apertures to receive the pair of first guide rods and the adjustment screw, a first attachment point, and a second attachment point spaced from the first attachment point, and wherein the adjustment screw, when actuated, is adapted to move the first carriage between the first hub mounting plate and the first motor mounting plate along the pair of first guide rods.

10. The fountain system of claim 9, further comprising:

a second linear guide adapted to be affixed to the exterior of the hub at a second location positioned circumferentially from the first location, the second linear guide including: a second hub mounting plate adapted to contact the exterior of the hub at the second location; a second motor mounting plate; a second adjustment screw; a pair of second guide rods adapted to couple the second motor mounting plate to the second hub mounting plate; and a second carriage positioned between the second hub mounting plate and the second motor mounting plate, wherein the second carriage includes apertures to receive the pair of second guide rods and the adjustment screw, a first attachment point, and a second attachment point spaced from the first attachment point, and wherein the adjustment screw, when actuated, is adapted to move the second carriage between the second hub mounting plate and the second motor mounting plate along the pair of second guide rods.

11. The fountain system of claim 10, further comprising:

a first linkage pivotally coupled between the first attachment point of the first carriage and the first link mounting ear of the first position adjustment assembly; a second linkage pivotally coupled between the second attachment point of the first carriage and the first link mounting ear of the second position adjustment assembly; a third linkage pivotally coupled between the first attachment point of the second carriage and the second link mounting ear of the first position adjustment assembly; and a fourth linkage pivotally coupled between the second attachment point of the second carriage and the second link mounting ear of the second position adjustment assembly.

12. The fountain system of claim 7, wherein the first and second support shafts and the hub are made from stainless steel, a plated steel, or a composite plastic.

13. The fountain system of claim 7, further comprising:

a controller coupled to the nozzle positioning assembly and the fluid pump, the controller controlling a position of the nozzle positioning assembly and fluid pumped by the fluid pump.

14. A nozzle positioning assembly, comprising:

a first support shaft having a body with a center aperture, a spherical first end, and a second end opposite the spherical first end; a first position adjustment assembly including a first shaft collar having a first body with a center aperture and a first link mounting ear extending from the first body and a second shaft collar having a second body with a center aperture and a second link mounting ear extending from the second body, wherein the first and second link mounting ears of the first position adjustment assembly are positioned circumferentially from one another, and wherein the center apertures of the first and second shaft collars are adapted to receive the second end of the first support shaft and at least one of the first and second shaft collars of the first position adjustment assembly is adapted to be affixed to the second end of the first support shaft; a second support shaft having a body with a center aperture, a spherical first end, and a second end opposite the spherical first end; a second position adjustment assembly including a third shaft collar having a first body with a center aperture and a first link mounting ear extending from the first body and a fourth shaft collar having a second body with a center aperture and a second link mounting ear extending from the second body, wherein the first and second link mounting ears of the second position adjustment assembly are positioned circumferentially from one another, and wherein the center apertures of the third and fourth shaft collars are adapted to receive the second end of the second support shaft and at least one of the third and fourth shaft collars of the second position adjustment assembly is adapted to be affixed to the second end of the second support shaft; a hub having a body with a center aperture, a first end configured to receive and rotatably retain the spherical first end of the first support shaft, and a second end configured to receive and rotatably retain the spherical first end of the second support shaft, wherein the first link mounting ears of the first and second position adjustment assemblies are substantially aligned along a first line parallel to a first axis of the hub and the second link mounting ears of the first and second position adjustment assemblies are substantially aligned along a second line parallel to the first axis of the hub; and a first linear guide adapted to be affixed to an exterior of the hub at a first location, the first linear guide including: a first hub mounting plate adapted to contact the exterior of the hub at the first location; a first motor mounting plate; a first adjustment screw; a pair of first guide rods adapted to couple the first motor mounting plate to the first hub mounting plate; and a first carriage positioned between the first hub mounting plate and the first motor mounting plate, wherein the first carriage includes apertures to receive the pair of first guide rods and the adjustment screw, a first attachment point, and a second attachment point spaced from the first attachment point, and wherein the adjustment screw, when actuated, is adapted to move the first carriage between the first hub mounting plate and the first motor mounting plate along the pair of first guide rods.

15. The nozzle positioning assembly of claim 14, further comprising: a second linear guide adapted to be affixed to the exterior of the hub at a second location positioned circumferentially from the first location, the second linear guide including: a second hub mounting plate adapted to contact the exterior of the hub at the second location; a second motor mounting plate; a second adjustment screw; a pair of second guide rods adapted to couple the second motor mounting plate to the second hub mounting plate; and a second carriage positioned between the second hub mounting plate and the second motor mounting plate, wherein the second carriage includes apertures to receive the pair of second guide rods and the adjustment screw, a first attachment point, and a second attachment point spaced from the first attachment point, and wherein the adjustment screw, when actuated, is adapted to move the second carriage between the second hub mounting plate and the second motor mounting plate along the pair of second guide rods.

16. The nozzle positioning assembly of claim 15, further comprising: a first linkage pivotally coupled between the first attachment point of the first carriage and the first link mounting ear of the first position adjustment assembly; a second linkage pivotally coupled between the second attachment point of the first carriage and the first link mounting ear of the second position adjustment assembly; a third linkage pivotally coupled between the first attachment point of the second carriage and the second link mounting ear of the first position adjustment assembly; and a fourth linkage pivotally coupled between the second attachment point of the second carriage and the second link mounting ear of the second position adjustment assembly.

* * * * *